United States Patent [19]

Macke

[11] 4,118,023

[45] Oct. 3, 1978

[54] CALIPER STITCH AND TRIM MACHINE

[76] Inventor: Thomas F. Macke, 525 S. E. 26th Ave., Fort Lauderdale, Fla. 33301

[21] Appl. No.: 676,057

[22] Filed: Apr. 12, 1976

Related U.S. Application Data

[63] Continuation-in-part of Ser. No. 299,819, Oct. 24, 1972, Pat. No. 3,938,799.

[51] Int. Cl.[2] ..... B65H 39/02

[52] U.S. Cl. ..... 270/54

[58] Field of Search ..... 270/53–57, 270/21; 83/158

[56] References Cited

U.S. PATENT DOCUMENTS

| | | | |
|---|---|---|---|
| 1,287,334 | 12/1918 | Kast | 270/53 |
| 3,559,516 | 2/1971 | Freeman | 83/158 |
| 3,658,318 | 4/1972 | Bunting | 270/55 |
| 3,664,655 | 5/1972 | McCain | 270/53 |
| 3,966,185 | 6/1976 | McCain | 270/54 |

*Primary Examiner*—Edgar S. Burr
*Assistant Examiner*—A. Heinz
*Attorney, Agent, or Firm*—Malin & Haley

[57] ABSTRACT

A caliper-stitch and trim machine arranges a generally upright or generally vertical array of inserted signatures in the form of a book from a signature-arranging device on a portion of a generally triangular saddle. The caliper-stitch and trim machine includes a caliper means, eject means, a book actuated stitch control means, stitch device, and a trimming mechanism. The caliper-stitch and trim machine also includes portion of the saddle having two arms to form a split saddle.The split saddle moves the book past the caliper means, through the stitch device and into the trimming device. A rejection blade moves upward through the split in the saddle to eject caliper rejected signatures. After the caliper accepts a book of acceptable thickness, the book actuates the stitch control means to operate the stitcher device to deliver staples to bind the book. The stitched book is forwarded onto a carrier blade in the trimming mechanism in the same generally upright position to be face-trimmed by a horizontally movable knife. The carrier blade is then moved upwardly to deliver the book utilizing centrifugal and gravitational forces to the head and foot trim position for trimming and delivery.

7 Claims, 34 Drawing Figures

CALIPER STITCH AND TRIM MACHINE

BACKGROUND OF THE INVENTION

This invention is a continuation in part of the signature-arranging device and method Pat. application No. 299,819, filed Oct. 24, 1972, issued Feb. 17, 1976, U.S. Pat. No. 3,938,799 and relates to a new and improved caliper-stitch and trim machine connected to a signature-arranging device this is a division of Application Ser. No. 393,914 now U.S. Pat. No. 4,004,796.

The original application relates generally to a signature inserting and collating device employed in a bookbinding operation, and specifically to a single device that can be utilized in providing either an array of signatures inserted into each other (inserting signature) or side-by-side (one on top of the other — collating). The original application discloses a signature-arranging device and a caliper-stitch and trim machine to which the claims of this application are directed.

In the past, book stitching and trimming machines were complex in design and costly to manufacture. Many such machines positioned the books in a horizontal plane prior to trimming. Other machine systems used memory means connected to the caliper to control the stitching operation in order to prevent stitching incomplete books.

Also in the prior art, two different machines were required for arranging signatures in two different arrays; one to insert them inside each other (inserting) and another for stacking one on top of the other (collating). Having different machines required more space, less flexibility and increased expense. The applicant's signature-arranging device provides a single device which can accomplish either operation utilizing a plurality of single transfer cylinders.

BRIEF DESCRIPTION OF ONE EMBODIMENT OF THE CALIPER-STITCH AND TRIM MACHINE

This caliper-stitch and trim machine receives from the common saddle an array of signatures inserted inside each other in book form on the forward stroke of the common reciprocating saddle from a signature-arranging device. The caliper-stitch and trim machine includes a caliper means, an eject means, a book actuated stitch control means, a stitch device, and a trimming mechanism. The caliper means measures the thickness of the book at the beginning of the return stroke of the saddle. The caliper means provides a signal that controls the eject means. The triangular saddle is split adjacent the eject means. The eject means includes a movable rejection blade that moves upwardly through the split saddle upon command of the caliper means signal to remove the incomplete unstitched book from the split saddle. The rejection blade moves the incomplete unstitched book to overhead ejection rollers for removal from the machine prior to entering the stitch device and trimming mechanism.

When the caliper means provides an accept signal, the acceptable book is moved into the stitch device under the stitch head on the second forward stroke of the saddle. The book actuates the stitch control means which actually places the stitch device in an operative condition. The stitch device includes a stitcher and clincher mechanism. When the stitch device is in an operative condition the stitcher delivers staples to the book at the beginning of the saddle's second return stroke. The stitcher's stitch head will remain inoperative when the stitch control means is not actuated by the presence of a completed book in the stitching station.

Thereafter, upon the third forward stroke of the saddle, the stitched book is moved to the trimming mechanism that includes a face trim mechanism and a head and foot trim mechanism. The book is moved from the saddle to a carrier blade in the face trim mechanism in the same generally upright or generally vertical saddle position. A hydraulic and/or mechanical operated knife in the face trim mechanism is actuated at the beginning of the third return stroke of the saddle. The knife includes a horizontally movable blade that trims the face of the book. The blade may also be operated by the book contacting a limit switch or by a timer cam on the main drive shaft of the machine.

After cutting the face of the book while the book is in a generally upright or generally vertical position, the carrier blade is moved upwardly after the horizontally movable blade is returned to its rest position. The carrier blade delivers the book to the drive rollers. The stitched and face-trimmed book is thereafter delivered by the drive rollers to the head and foot trim mechanism to position each book in a generally downward sloping position. The delivery rollers and guides create centrifugal force in the book to direct the book, along with gravitational force, toward the head and foot trim mechanism. A registration assembly adjacent the registration means may adjust the book prior to trimming. A book actuated limit switch or a timer cam may actuate the head and foot knives to trim the head and foot of the book at the beginning of the fourth return stroke of the saddle. After the head and foot of the book is trimmed, the book is moved by gravity and/or a mechanical kicker or air blast to a delivery conveyor belt.

It is an object of the caliper-stitch and trim invention to provide a non-complex caliper-stitch and trim machine.

Another object of this invention is to provide a non-complex carrier saddle for an inserting, caliper-stitch and trim machine.

Another object of this invention is to provide an eject means at the caliper station, prior to stitching.

Another object of this invention is to provide a pickup means that easily removes signatures from a magazine and automatically separates the sheet of material lying on the pickup means from an adjacent overlying sheet of material.

A further object of this invention is to maintain a book in a generally upright or vertical position through the caliper means, stitching device and the face trim mechanism.

A further object of this invention is to move the book to the head and foot trimming knives by utilizing centrifugal and gravitational forces.

Another object of this invention is to provide a book trimming mechanism that face trims the book in a generally vertical or oblique position and that trims the head and foot of the book in an oblique position.

Still a further object of this invention is to provide a stitching device operable by the presence of a completed book to be stitched at the stitching device station, eliminating the need for a book memory system.

Another object of this invention is to enable the mechanism to function in one direction, collating signatures, without operating the ejector, stitcher or trimmer devices.

An additional object of this invention is to provide a single saddle in the signature-arranging device and the caliper-stitch and trim mechanism.

BRIEF DESCRIPTION OF THE SIGNATURE-ARRANGING DEVICE

The signature-arranging device for inserting and/or collating signatures or single sheets of paper in a bookbinding operation includes a signature holding magazine, a transfer cylinder having a signature pickup means, a vacuum aperture coupled adjacent said magazine, a signature receiving means, and a linear, reciprocating pusher finger adjacent said receiving means, said finger adjustable relative to the receiving means to a first position for moving inserted signatures in a first direction and to a second position for moving collated signatures in a second direction.

In operation, signatures are placed in a holding magazine with the signature backbone pointing toward the cylinder or away from the cylinder dependant upon the desired signature array, either inserted or collated.

A signature is defined as a sheet of paper folded in a predetermined pattern a number of times in one of the following multiples: 4, 8, 12, 16, 20, 24, 32, 36, 48, or 64.

For providing an inserted (one inside the other) signature array, signatures are positioned with the backbone pointing toward cylinder and are removed from the holding magazine by vacuum operated holding means located on the continuously rotating transfer cylinder surface, which rotates the signature to a predetermined point of cylinder travel. At that point, the vacuum is shut off, releasing the signature from the cylinder surface. Centrifugal force from rotation and a braking force opens one side of the signature (the other side being held firmly to the cylinder surface) until vacuum cutoff. At cutoff, the opened signature is released and its downward momentum moves it onto the top of a triangularly shaped saddle.

For the collated array, the signatures are stacked in the same holding magazine with the signature backbones pointing away from the cylinder. The vacuum again holds the bottom signature in the magazine to the continuously rotating cylinder surface. At vacuum cutoff (at the predetermined point of cylinder travel), the signature is released (backbone downward), its downward momentum carrying it into a collating tray.

A plurality of transfer cylinders are disposed along a common shaft which provides unitized rotational motion for all cylinders from a single motor or drive means. After a signature is received, either on the saddle apex or in the collating tray, it is moved laterally to a position adjacent the next in line cylinder where another signature is deposited in a similar manner either inserted over or side-by-side to the previously deposited signature. Thus, progressing in the direction of work flow from cylinder to cylinder, a stack of signatures in the desired array will be formed. After the last signature has been deposited at the end line cylinder, the signature array is then moved to the next binding operational stage such as stitching or glueing.

The work flow direction is dependent upon the particular signature array desired. The position of a reversible or removable pusher finger determines the actual direction of work flow and allows for individual or split, simultaneous signature array operation, i.e., inserting or collating.

In one embodiment, the saddle and pusher fingers are constructed as a unit, so as to move as a unit. An attachable pusher finger is necessary with unitary construction with a reciprocating saddle to reverse the direction of work flow.

In an alternate embodiment, the saddle and collating tray are stationary with a pair of movable pusher fingers coupled below the saddle to move the signature stacks to adjacent cylinders. In this embodiment, work flow direction is reversed by a 180° rotation of only one of the pusher fingers.

The motion in either embodiment, i.e., the unitary saddle and pusher fingers or the pusher fingers relative to the stationary collating tray and saddle, is reciprocal, moving back and forth between adjacent cylinders only.

It is an object of the signature-arranging invention to provide a single device which collates signatures and single sheets of paper or inserts signatures inside each other (inserting) for bookbinding operations.

It is another object of this invention to provide a simplified machine which accomplishes assembling of folded sheets of paper into different arrays with a single device.

And yet another object of this invention is to provide a multi-operational inserting and/or collating device utilizing a single drum with vacuum pickups.

And yet still another object of this invention is to provide a dual purpose machine which collates folded sheets of paper both on top of each other or inserts them into each other either independently or simultaneously.

In accordance with these and other objects which will be apparent hereinafter, the instant invention will now be described with particular reference to the accompanying drawings.

BRIEF DESCRIPTION OF THE DRAWINGS

In the drawings:

FIG. 7A is a partial view of a saddle in FIG. 6 and other fingers and the work flowing to the left.

PREFERRED EMBODIMENT OF THE INVENTION

Figure 1:
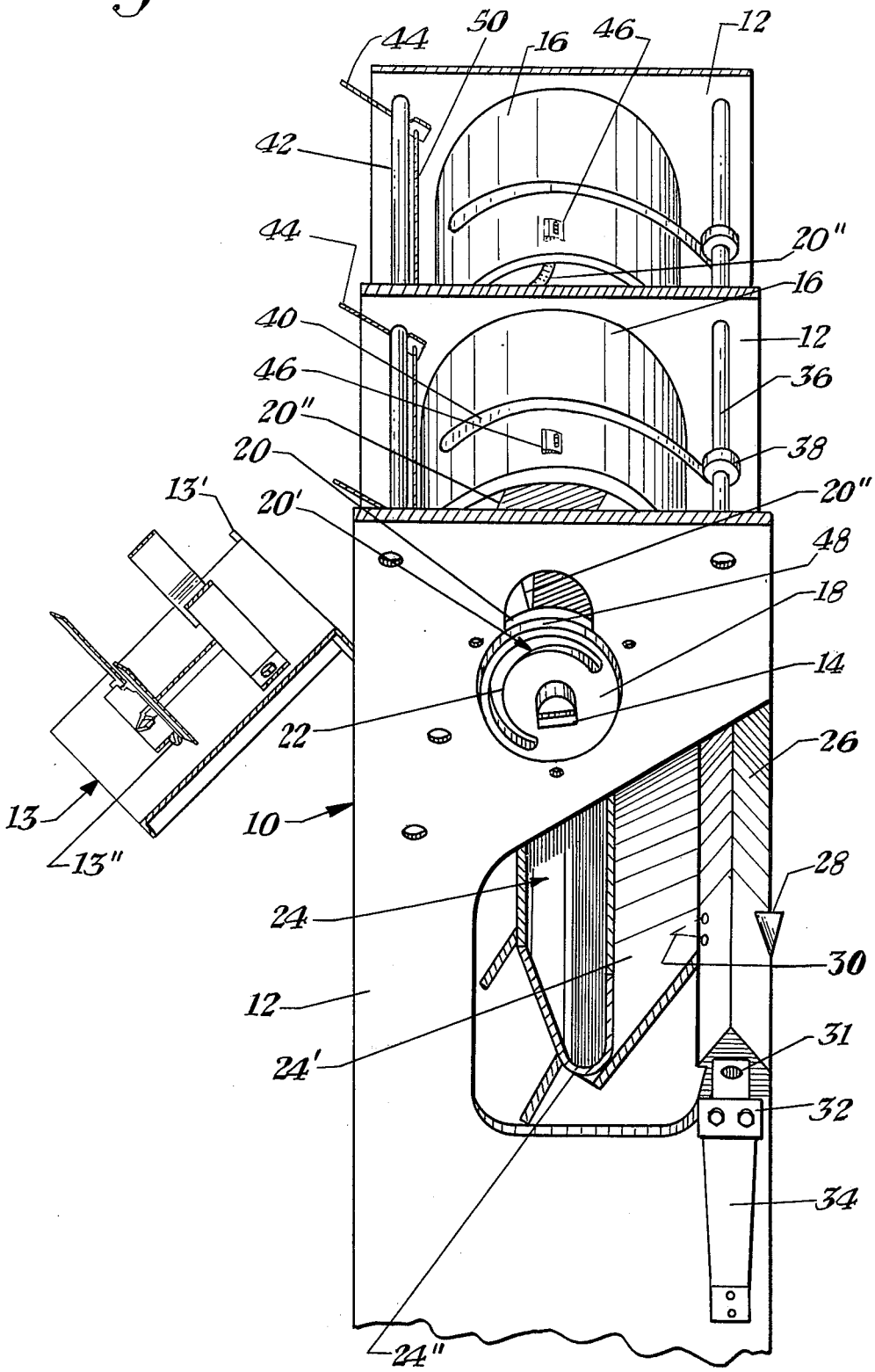
FIG. 1, is a perspective view of a signature-arranging device with the holding magazine exploded away from the housing and showing a sheet material separator device.

Referring now to the drawings, and in particular to FIG. 1, one embodiment of applicant's device is shown generally at 10 comprising a two drum device, the operation being the same at each drum. Any number of drums may be utilized dependant upon the number of different signatures to be inserted or collated.

The device is housed and supported by a plurality of rigid, vertical plates 12 connected together by top cross-bars 36 and 42 and a plurality of bottom cross-bars (not shown). Transfer drums 16 are rototably mounted on a common shaft between adjacent support plates 12 within vacuum aperture means. Shaft 14 is connected to a fixed special bushing 18 having a vacuum mask chamber 22 and vacuum inlet 48. The movable mask plate 20 coupled and rotating with shaft 14 includes hole 20′ and pipe 20″. The vacuum operation is explained below. A motor (not shown) drives common shaft 14, thus rotating drums 16 simultaneously. Additional drums may be connected along the common shaft as required.

Along one side, in line, a plurality of signature-holding magazines 13 are coupled adjacent and facing drums 16. Signatures are stacked into the magazines 13 and are transferred individually, bottom first to the drum surface allowing for continuous loading. The magazines 13 are adjustable in length and width to accommodate various sized signatures. The base of magazine 13 is pivotable at 13′ and the back support of magazine 13 is pivotable at 13″.

Coupled between the magazines 13 and the drum 16 are a plurality of air jet bars 50 supported by arms 44 connected to cross-bar 42. Air under pressure is forced out through small apertures in bar 50 to separate like signatures to prevent the vacuum pickup boxes 46 or a sheet material separator device on the drum from picking up more than one signature.

Vacuum pickup boxes 46 are mounted on each drum surface for pulling the signature from the magazine 13 and holding the signature to the drum surface during transfer.

Mounted on the opposite side and below the drums is the signature collating tray 24 including fixed tray portion 24′ and adjustable tray portion 24″ adjacent to triangularly shaped reciprocating saddle 26 which includes pusher fingers 28 and 30 (shown removed by the dotted lines), the saddle and fingers movably mounted on stationary support 32. Tray portion 24″ is adjustable up and down to accommodate different book widths. Mounting bracket 32 couples support 32 to plate 12. The saddle 26 is driven by a motor (not shown) in linear, reciprocating motion. The reciprocating saddle stroke is greater than the distance between adjacent plates 12 or adjacent pusher fingers 28. A guide 40, with adjusting cam means 38, holds the signature adjacent the drum 16 during transfer.

Figure 2A:
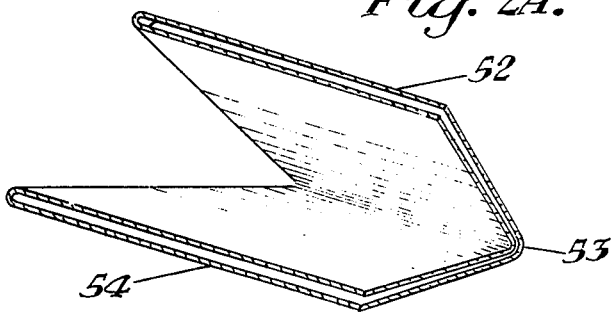
FIG. 2A, shows a typical signature utilized with the signature-arranging invention.

FIG. 2A shows a typical eight page signature 52 which may be utilized in applicant's invention, the backbone being 53 the final fold in a signature and 54 being a first fold.

Figure 2B:
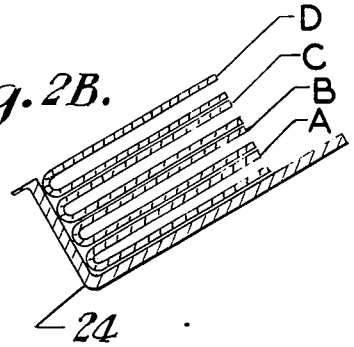
FIGS. 2B and 2C, show different signature arrays produced by the signature-arranging invention.

FIG. 2B shows four signatures A, B, C, and D stacked side-by-side one upon another (collated) achieved in one mode of operation of applicant's invention.

Figure 2C:
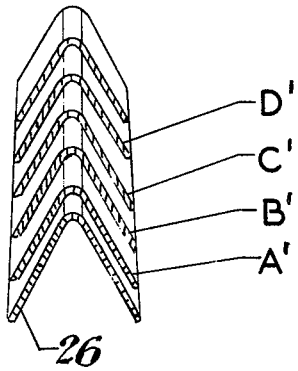

FIG. 2C shows four signatures A′, B′, C′, and D′ inserted into each other (inserted) on saddle 26 achieved in an alternate mode of operation.

Collating Mode

Figure 3C:
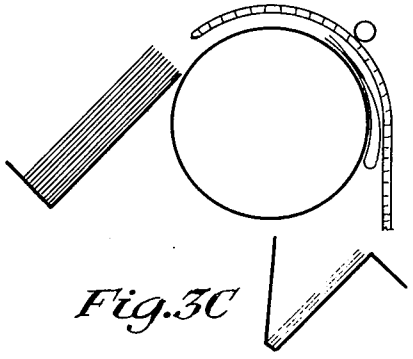
FIGS. 3A, 3B, and 3C, show schematically the operation of the signature-arranging invention for collating signatures in a collating tray.
Figure 3B:
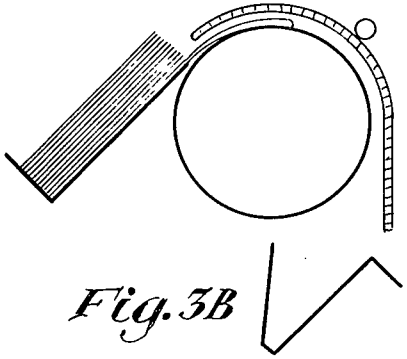
Figure 3A:
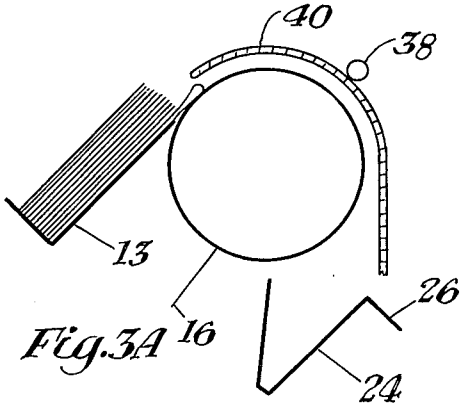

FIG. 3A shows the transfer cylinder 16 coupled to a signature so that a point on its surface is tangentially engaged with the bottom sheet of the signature stacked in the holding magazine 13. The bottom signature is held to the drum by a vacuum aperture and is rotated and taken from the magazine around the drum as its rotates. The signatures in the magazine are stacked with the backbones closer to and adjacent the drum.

FIG. 3B shows the signature removed from the holding magazine 13 and partially under guide 40.

FIG. 3C shows the signature approximately 180° from its starting position at which point the vacuum holding the edge is released while the cylinder continues to rotate. The vacuum is controlled by an ordinary vacuum mask chamber 22. Approximately the same moment when the first signature is released another signature is removed from the bottom of the magazine and held on the cylinder by another vacuum pickup means at approximately 180° from the first vacuum pickup means. Once the vacuum on the cylinder aperture is released at the predetermined cylinder position, momentum will drive the signature down into the collating tray 24, backbone first. The signature is then moved along to the next drum with others that have been previously positioned in the same way. Since the signature was positioned within the magazine with the backbone adjacent the cylinder, the entire signature will move into the tray as shown in FIG. 3C. A plurality of cylinders and a collating tray are disposed along a linear axis and each signature group is transferred by the reciprocating saddle motion in the collating tray to the next stage or next cylinder. When another signature comes down and it is positioned adjacent the one previously deposited. Ultimately, at the end of the work line, the signatures will be stacked in a collated array, i.e., side-by-side, one on top of another as in FIG. 2B.

Inserting Mode

Figure 4C:
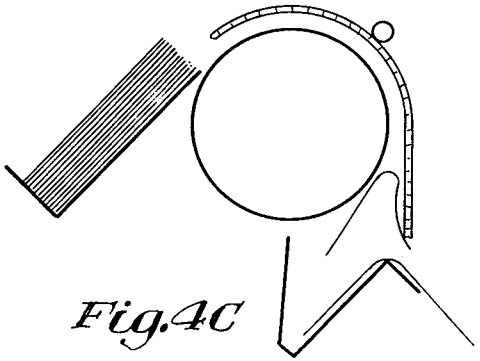
FIGS. 4A, 4B, 4C, show schematically the operation of the signature-arranging invention for inserting signatures into each other and onto a saddle.
Figure 4B:
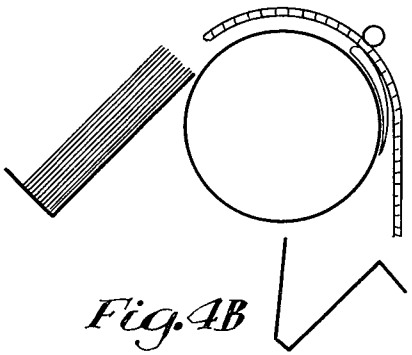
Figure 4A:
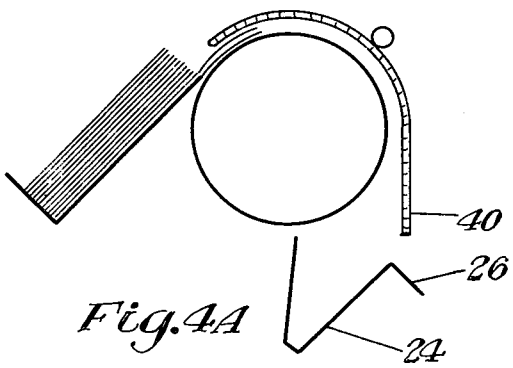

FIG. 4A shows the same device with the signatures arranged in the holding magazine 13 so that the signature open end or face is toward the cylinder (backbone reversed from collating). The signature will be held to the cylinder as it is pulled out of the holding magazine as shown in FIG. 4A. FIG. 4C shows a signature with the open-face down and the signature edge at the predetermined rotation position of the drum whereby one side of folded pages are still coupled to the drum by the vacuum, while the other side will open due to the centrifugal force of rotation and other means to open the signature as shown in FIGS. 4B and 4C. At a predetermined position, the vacuum is shut off which disengages the signature from the drum. Momentum and gravity drives the signature onto the saddle apex. Thus, the signature straddles the saddle 26, the backbone being along the top of the saddle. After receipt on the saddle as shown in FIG. 4C, the signatures will move in a group to the next stage where another signature will be dropped on top of the previously positioned one. Thus, a plurality of signatures will be stacked inside each other and will be moved as a unit until the requisite numbers have been stacked together and thereafter they will be moved to the next operation station.

Signature Array Movement

Figure 5:
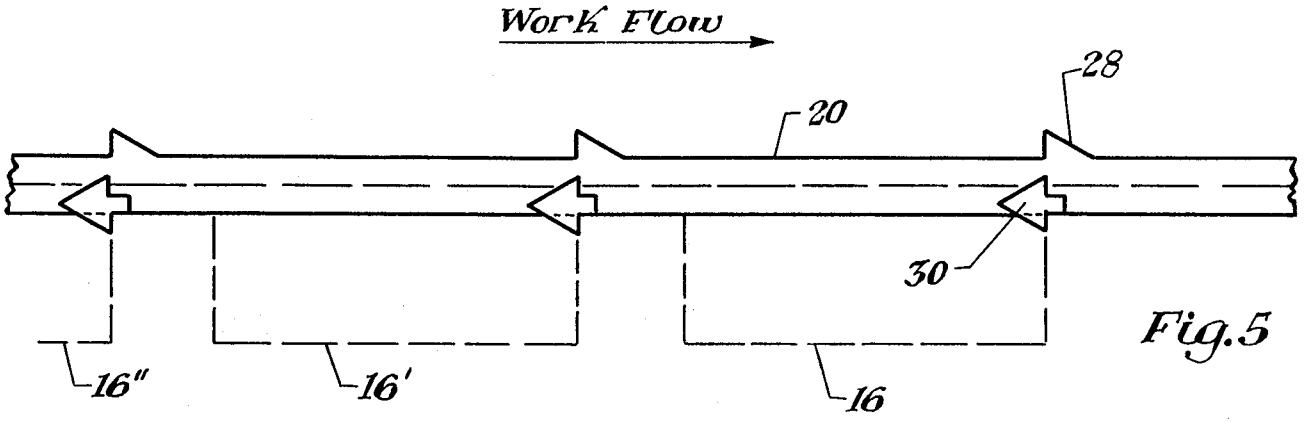
FIG. 5, shows a schematic of the saddle transfer mechanism utilized in the signature-arranging invention.

FIGS. 1 and 5 show a plurality of cylinders disposed above the saddle and collating tray and the direction of work flow (collating) dependant upon the position of pusherfinger 30. The fingers move in a reciprocating manner, linearly between adjacent transfer cylinders to move the work load (signature array) along to the next step. The tray in FIG. 1 receives signatures and provides for collating folded signatures one on top of the other utilizing only a single transfer cylinder system at each cylinder station 16, 16', and 16''. With the position of pusher finger 30 pointed away from the direction of the work flow (with the protruding back portion), FIGS. 5 and 7B, as each signature is dropped into the tray and contacts pusher finger 30, motion of the finger to the right will move and slide the signatures along the tray until the finger reverses direction. It should be noted that in the preferred embodiment (FIG. 1), the saddle 26 and pusher fingers 28 and 30 (shown in dotted lines) (added for collating) move as a unit.

In the alternate embodiment shown in FIG. 5, the saddle may remain stationary, with the pusher fingers moving the work. When motion of the finger is opposite the work flow, the finger, having a tapered portion, will slide under the signatures allowing the finger to return to the adjacent cylinder without moving any signatures in the direction away from work flow. A movable stripper 56 (in either embodiment) also prohibits backward motion of the work flow. Upon transferring of the next signature at each station, the procedures is repeated continuously.

Figure 6:
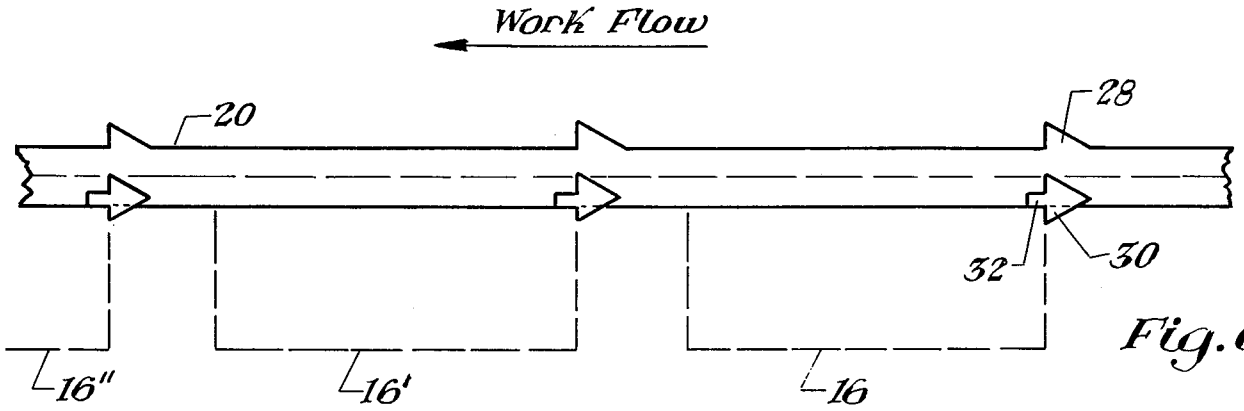
FIG. 6, shows a schematic of the saddle transfer mechanism utilized in the signature-arranging invention is a different mode of operation than FIG. 5.
Figure 7A:
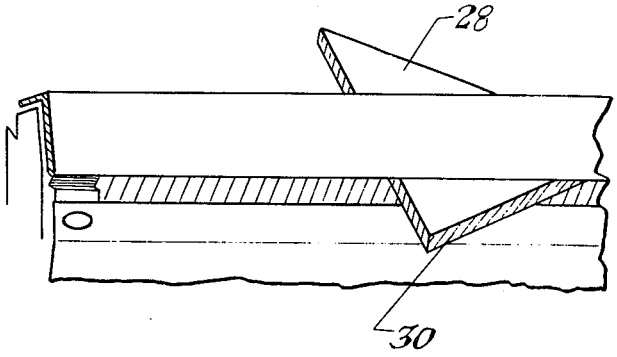
FIGS. 7A' (reverse of FIG. 6) and 7B, show a partial view in perspective of the saddle and pusher fingers utilized in one embodiment of the signature-arranging invention with work flowing to the right.
Figure 7A:
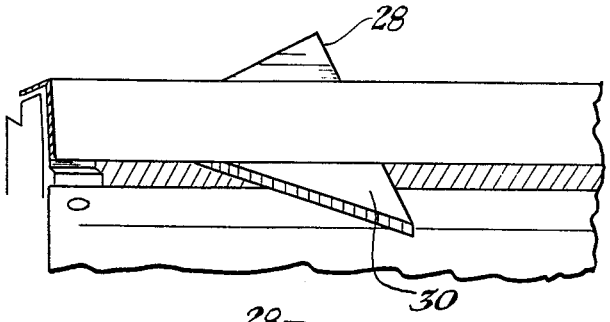
Figure 7B:
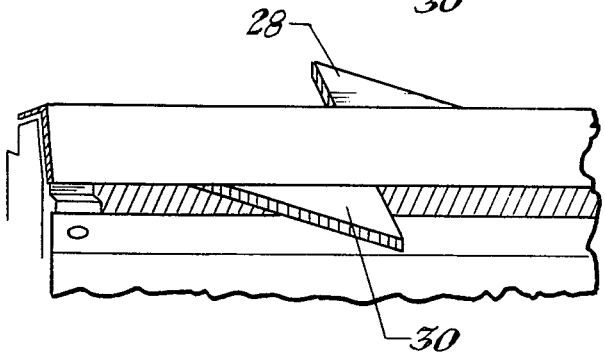
Figure 9:
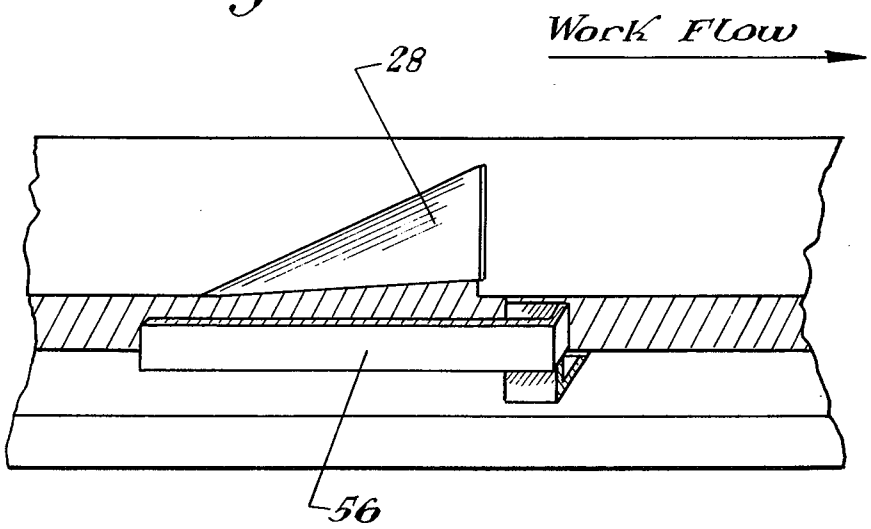
FIG. 9, shows an enlarged view of a stripper adjacent one embodiment of the reciprocating saddle.

FIGS. 6 and 7A shows the same device (for inserting with finger 30 rotated 180° and pointed again in the direction opposite the work flow. In this position the protruding back portion (which is perpendicular to the work flow direction) contact folded signatures resting on the saddle that are placed on top of and into each other and moves them to the left. Upon the reversal of motion of the fingers 28 and 30, the signatures will remain in their position by means of movable strippers in front of the adjacent cylinder while the fingers return back to their former positions. In the preferred embodiment in FIG. 1, finger 30 is removed; the saddle and finger 28 move the inserted signatures. Movable stripper 56 (FIG. 9) prevents backward motion of the signature as the saddle and finger 28 return to a position in front of the adjacent cylinder.

Thus, in operation applicant's invention can provide different signature stacking arrays with a single device by merely removing or rotating a pusher finger located on or adjacent the saddle. Also, either operation can be accomplished utilizing a single transfer drum system.

Figure 8:
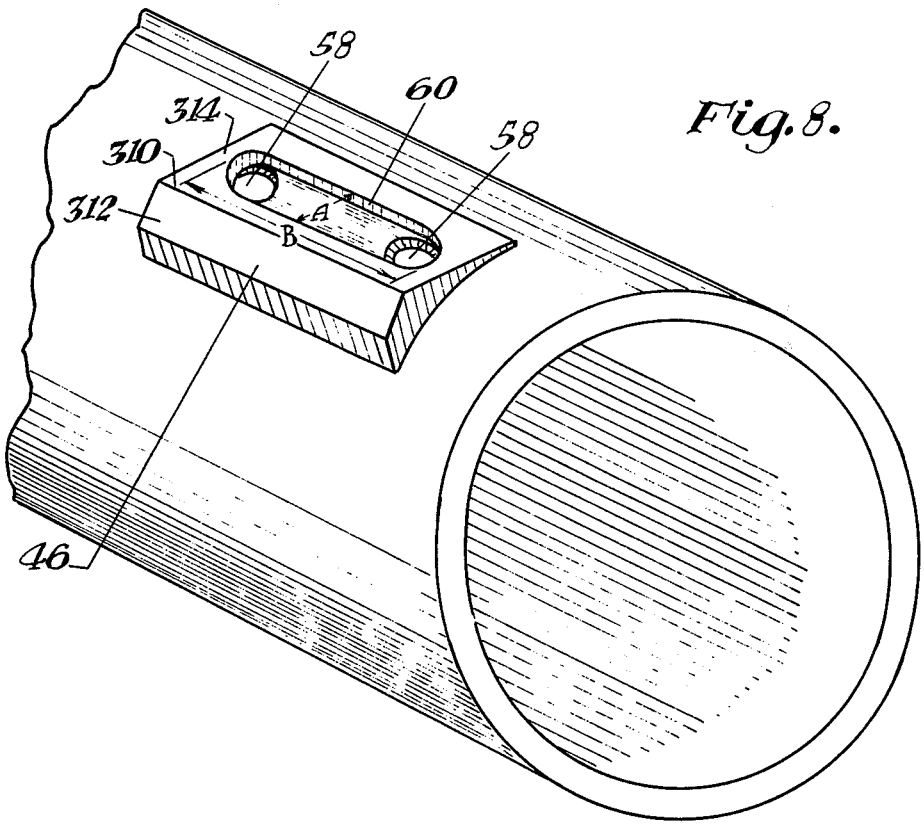
FIG. 8, shows a partial view in perspective of a transfer cylinder and vacuum aperture utilized in the signature-arranging invention.

FIG. 8 shows a transfer cylinder with a vacuum pickup box or sheet material separator device 46 with vacuum aperatures 58 through the cylinder surface connected to the vacuum source. A channel or connecting means 60 links the aperatures 58 along the surface. The pickup box 46 has an angled surface including flat contact surface 314 which contacts the bottom signatures' surface in the holding magazine. The angle insures flush engagement between the signature and flat contact surface 214 the pickup box.

A vacuum tube which rotates with the drum is connected to the aperatures 58 at one end and adjacent mask plate 20 at the other end. As the tube end passes vacuum mask chamber 22 (FIG. 1) the vacuum will be on. The operation of the vacuum system is well known and any conventional system may be utilized.

Figure 10:
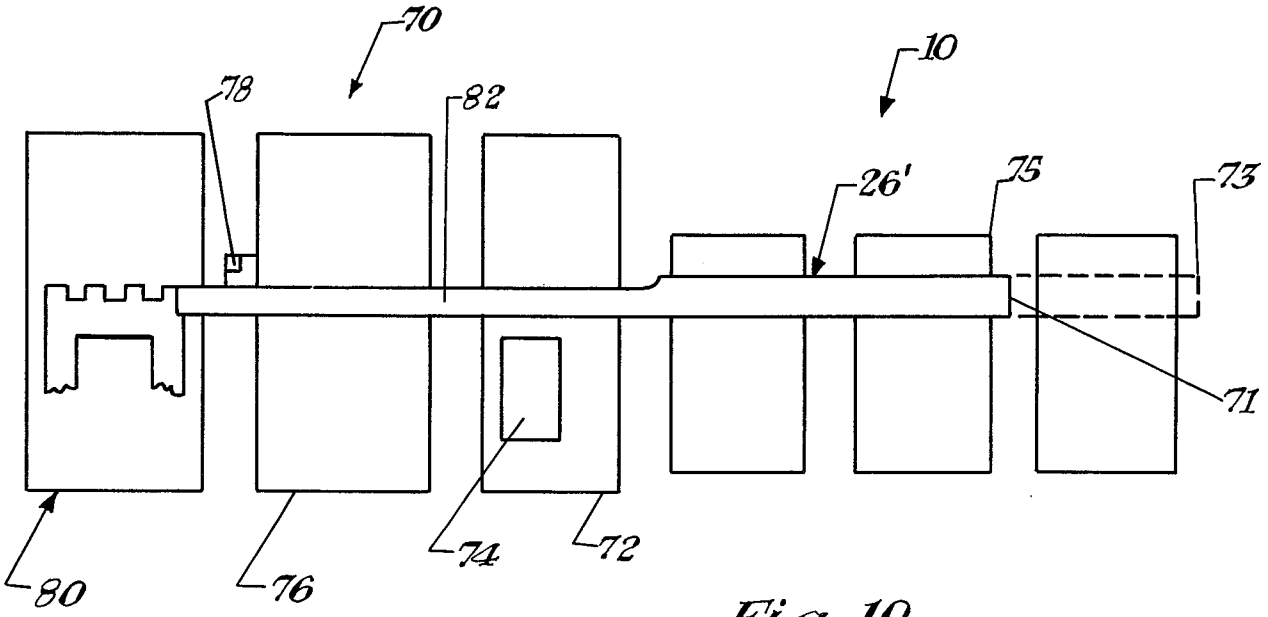
FIG. 10, a block diagram of the signature-arranging device and the caliper-stitch and trim machine.

Referring now to FIG. 10, the signature-arranging device, generally designated by numeral 10, and the caliper-stitch and trim machine, designated by numeral 70, are connected by a single reciprocating saddle 26'. The caliper-stitch and trim machine includes a caliper means 72, and eject means 74, a stitch device 76, a stitch control means 78 and a trimming mechanism 80. The single reciprocating saddle 26' is driven by a drive motor.

Figure 11:
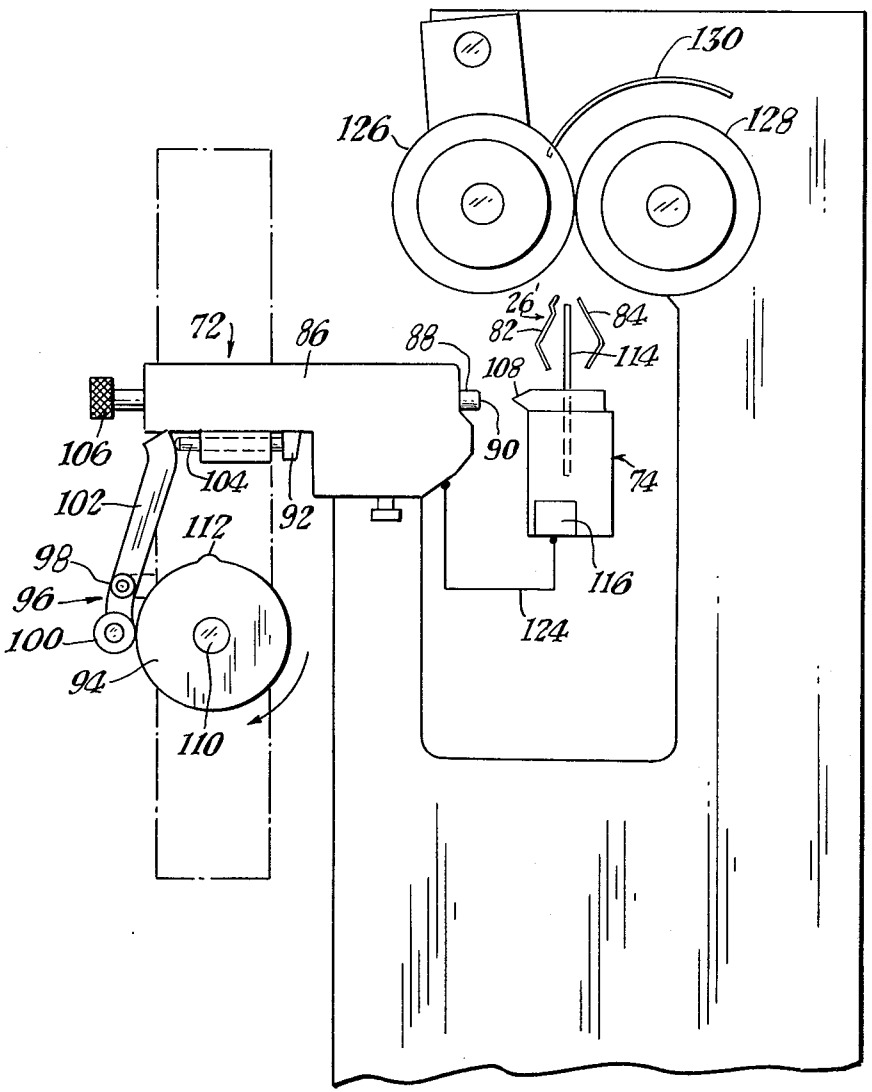
FIG. 11, an end view of the caliper and eject means partially in cross-section of FIG. 13 taken along line A—A.
Figure 12:
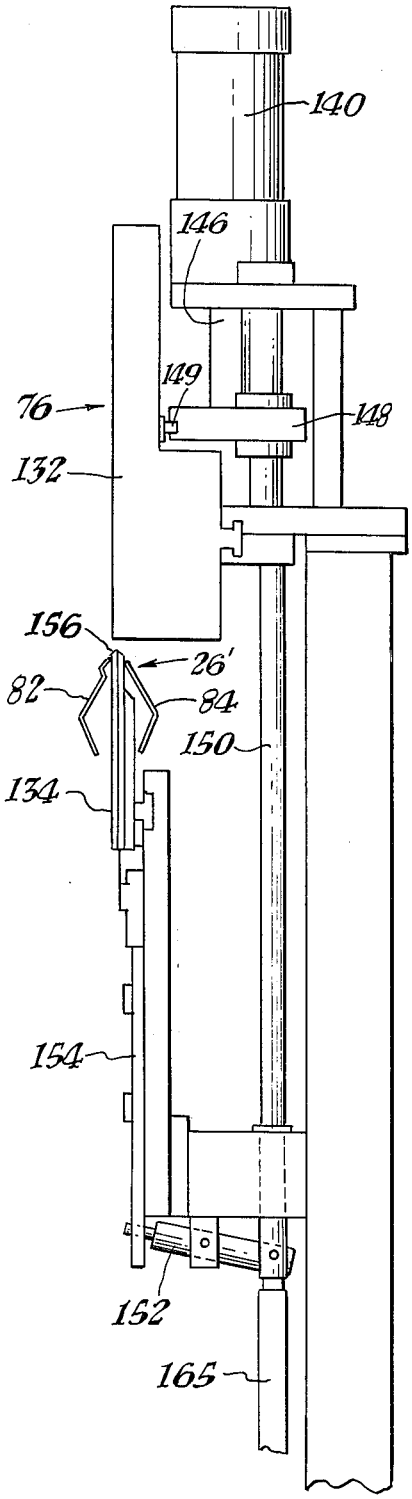
FIG. 12, is an end view of the stitcher, partially in cross-section of FIG. 14 taken along line B—B.

In the use, the signature-arranging device 10, as described in detail hereinabove, arranges a plurality of signatures inserted inside each other to form a book on the generally triangular-shaped reciprocating single saddle 26'. The end 71 of the single saddle 26' moves between point 73 and 75. The other end of the single saddle 26' is split into two sides or arms 82 and 84, as shown in FIGS. 10, 11 and 12. The separated sides pass through the caliper means 72, the eject means 74 and the stitch device 76. The single saddle 26' supports and moves the book through the caliper and eject position and then supports and moves the book through the stitching position. Thereafter the single saddle pushes the book into the trimming position. The first forward stroke of the single saddle 26', after the signature-arranging device 10 assembles the book, is used to deliver the book to the caliper position.

Figure 13:
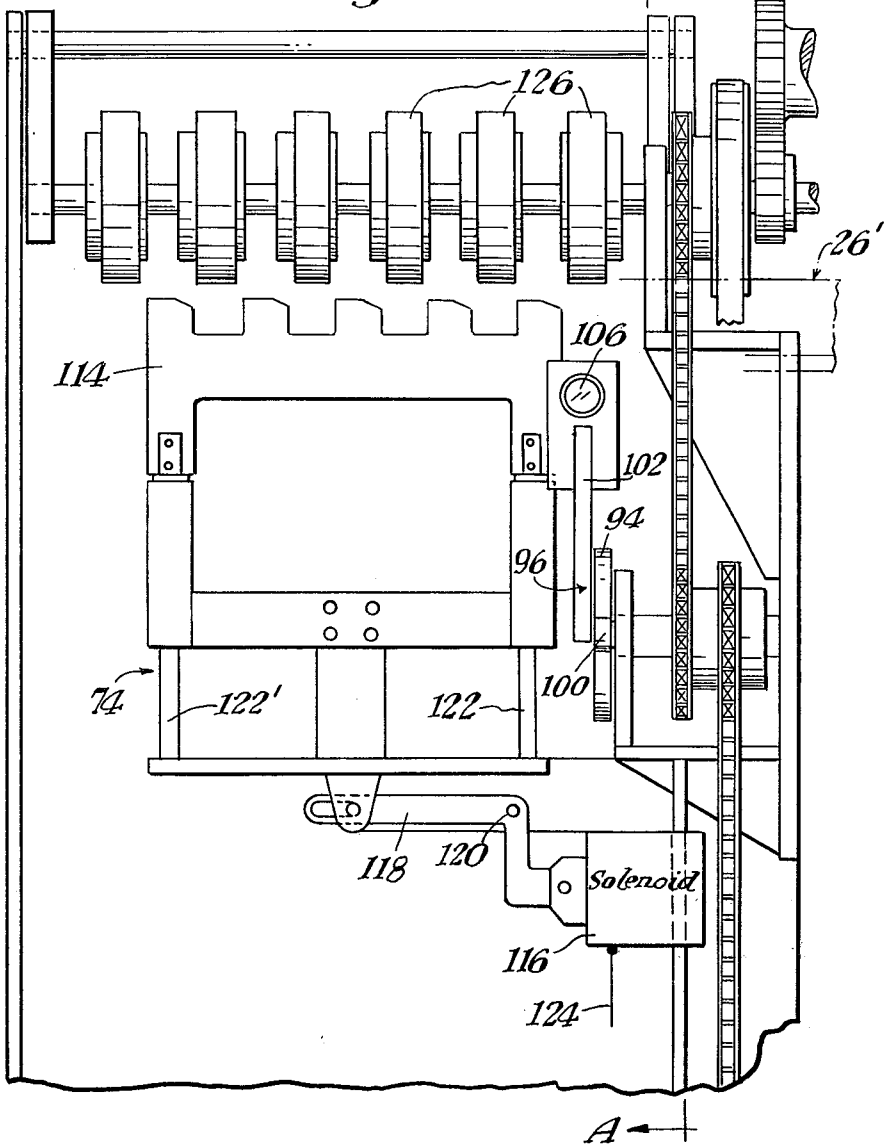
FIG. 13, is a side view of the caliper and eject means.

Referring to FIGS. 11 and 13, the caliper means, generally designated by numeral 72, includes a body portion 86 with a movable sensing arm 88 having a measuring surface 90, and a lower trigger portion 92 connected to said sensing arm 88 through an intermediate biasing means or spring means (not shown). The sensing arm 88 is actuated by a cam 94. Cam 94 is driven by the main drive motor connected to a drive shaft (not shown). The caliper means 72 is actuated by the cam 94 by linkage arm 96 that pivots about pin 98. Cam follower 100 on one end of linkage arm 96 engages the surface of cam 94 to move the upper end of link arm 102 into engagement with the pin 104 to drive said pin into engagement with the lower trigger portion 92. The sensing arm 88 is biased by a spring (not shown) into a rearward position as shown in FIG. 11. Adjusting screw means 106 is connected to the caliper sensing means to adjust the caliper means 72 to sense for an undersized book on the single saddle 26'. If the thickness of the book lying between the measuring surface 90 and anvil 108 is undersized, the caliper sensing means provides an eject signal. The eject signal may be an electrical signal. Caliper anvil 108 is positioned relative to the measuring surface 90 of the caliper sensing arm 88. Anvil 108 is positioned below the single saddle 26' that moves a book (not shown) into the caliper position. The caliper means 72 may be actuated by a mechanical connecting means between the single saddle drive means and cam shaft 110. The cam 94 on cam shaft 110 is actuated to place the cam lobe 112 under cam follower 100 at the beginning of the first reverse stroke of the single saddle 26'.

The single saddle 26' is open along the upper portion thereof as shown in FIGS. 10 and 11. The single saddle 26' is open between the caliper position and the distal end of the saddle.

The eject means 74, FIGS. 11 and 13, include a reject blade 114 driven upwardly by solenoid 116. Linkage member 118 is driven by solenoid 116. Linkage member 118 pivots about pivot point 120. Linkage member 118 moves rejection blade arms 122 and 122' upward. The reject blade arms 122 and 122' are connected to rejection blade 114. The rejection blade 114 is driven upwardly to eject an undersized book, that is rejected by the caliper means 72. The rejection blade 114 moves upwardly through the opening between the two sides or arms 82 and 84 of the single saddle 26'.

When the caliper senses an undersized book, a signal is sent through electrical wire 124, as shown in FIG. 11, to a solenoid 116 to actuate the rejection blade 114 in eject means 74. The rejection blade 114 moves upwardly carrying the undersized book into engagement with the rejection rolls 126 and 128. The rejection rolls are driven by a mechanical or belt link (not shown) connected to the main drive motor. The rejected book moves upwardly into engagement with the fixed guide member 130 that directs the unacceptable book from the caliper-stitch and trim machine 70 prior to stitching and trimming.

Figure 14:
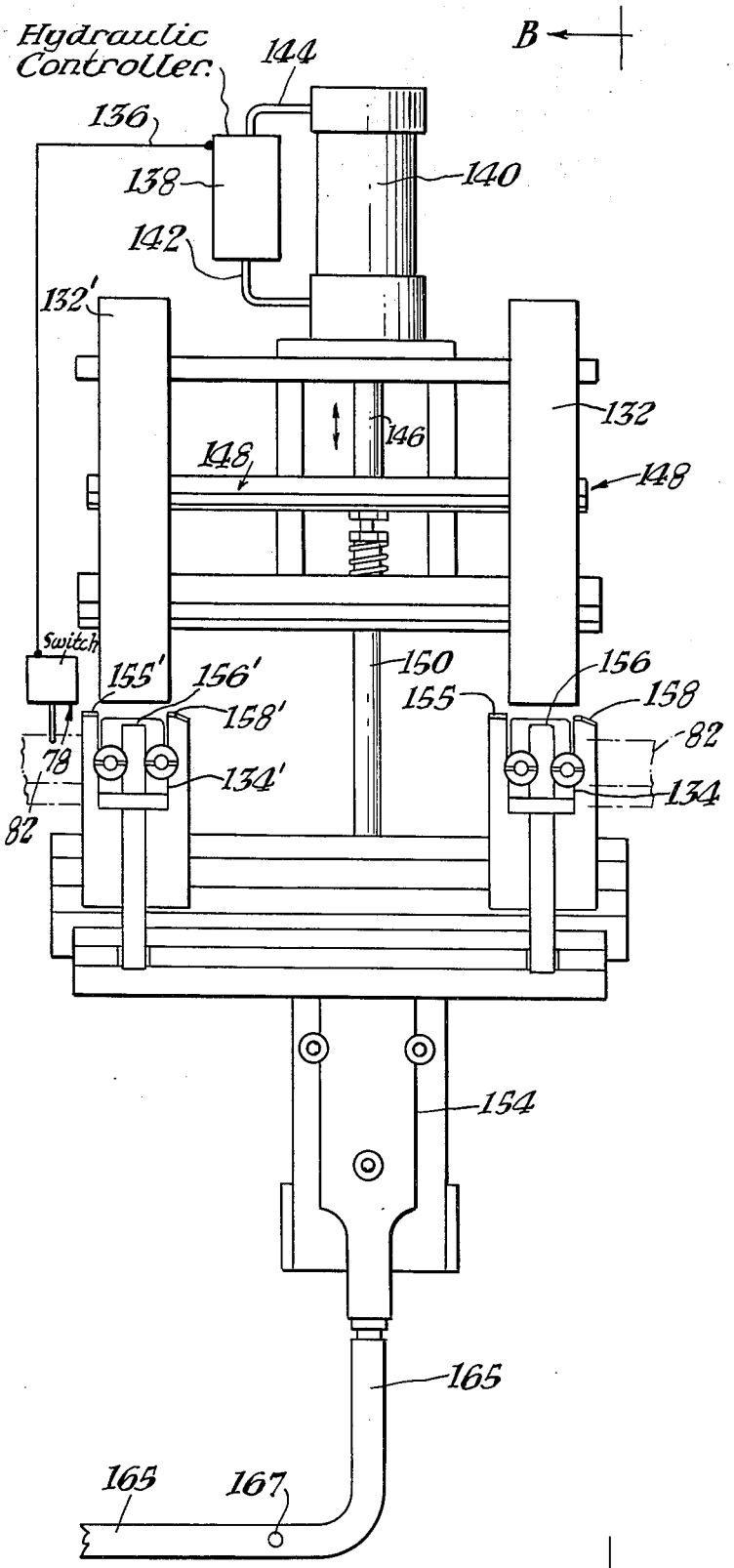
FIG. 14, is a side view of the stitcher.

An acceptable book is thereafter moved from the caliper eject position on the second forward stroke of the single saddle 26' to the stitching position, as shown in FIGS. 12 and 14. An end view of the stitching position is shown in FIG. 12 and a side view of the stitching position is shown in FIG. 14. The stitching device 76 shows two staple forming mechanisms 132 and 132' and two clincher mechanisms 134 and 134'. The staple mechanisms contain wire that is formed into staples to stitch the book into a unit. When a book actuates the horizontally adjustable stitch control means 78, as shown in FIG. 14, by engaging the switch finger, an electrical signal is transmitted from switch 78 by wire 136 to the hydraulic controller 138. The hydraulic controller 138 directs hydraulic fluid into and out of the hydraulic cylinder 140 through line 142 and 144. The hydraulic cylinder 140 includes a shaft 146 that moves the stitcher operator plate 148, the stitcher actuating rod 149 and clincher linkage members. The clincher linkage members include operating rod 150 and flat link 152, and clincher push bar 154 connected to clincher mechanism 134 and 134'. The internal staple mechanisms 132 and 132' and clincher anvils 156 and 156' move toward each other to stitch a book there between with staples. The staples (not shown) are driven through the book at separate locations. The upper edge of the single saddle 26' is open throughout the stitching position. The stitching operation starts at the beginning of the second reverse movement of the single saddle 26' after a book engages sensor 78.

The single saddle 26' deposits a book in the stitching device 76. When the saddle 26' is reversed and moved out of the stitching device, the book is supported on clincher guides 155, 155', 158 and 158'. Other guide means may be also positioned in said stitching device 76.

Figure 15:
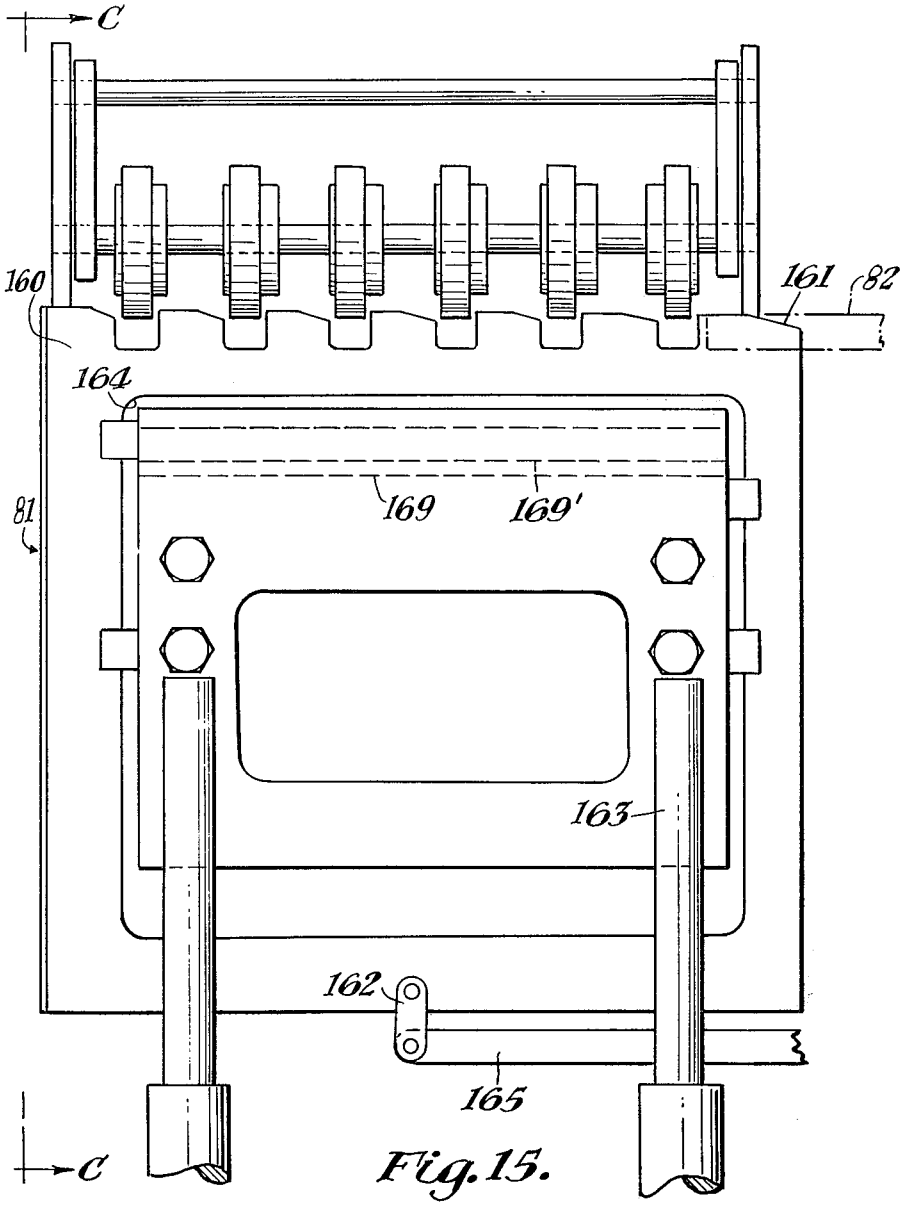
FIG. 15, is a side view of the face trimmer mechanism.
Figure 16:
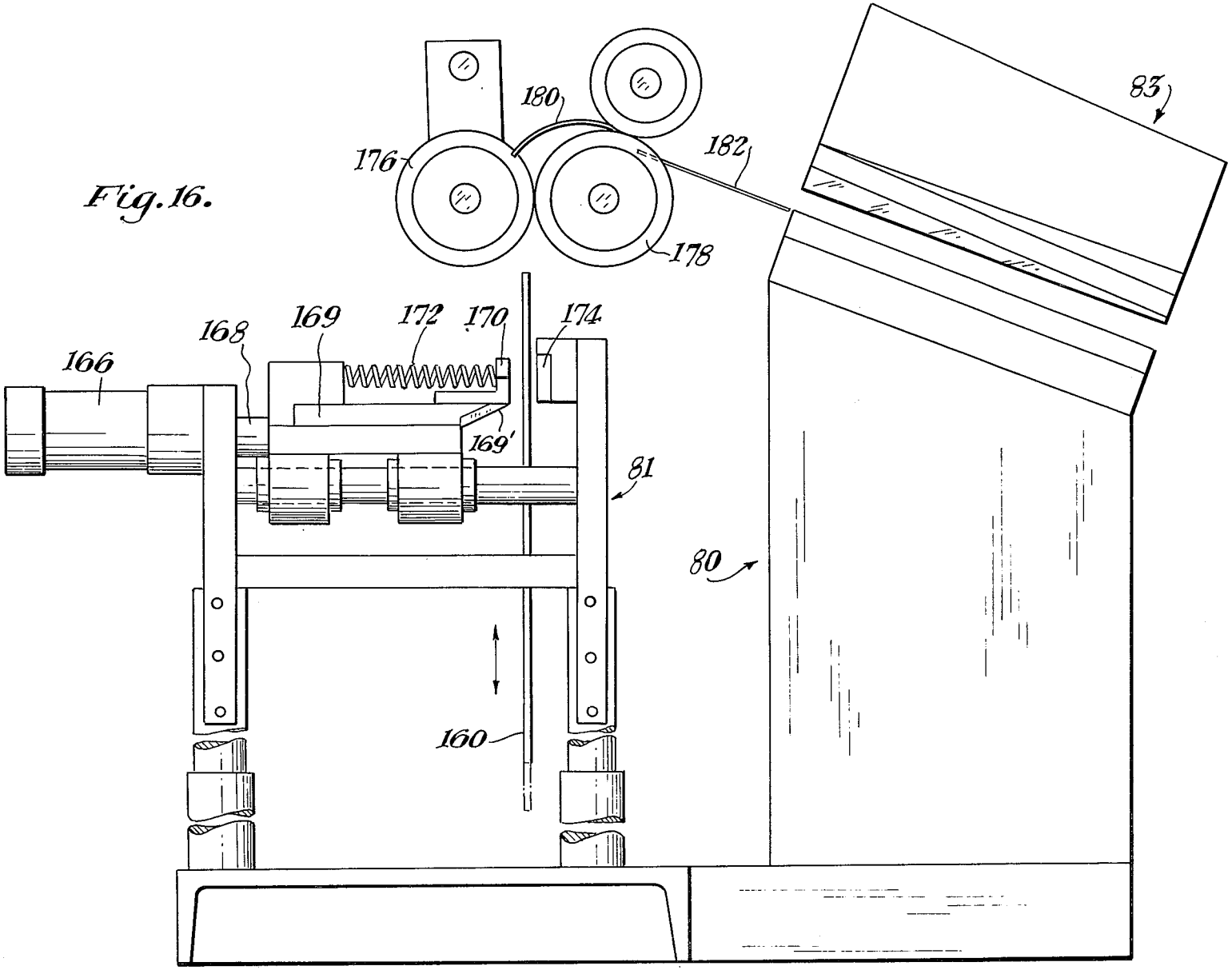
FIG. 16, is an end view of the face, head and foot trimmer, in cross-section of FIG. 15 taken along line C—C.

Referring now to FIGS. 15 and 16, the trimming mechanism 80 includes a two-stage device; first, a face-trimming mechanism 81 that trims the face of the book while it is held in a generally vertical position on the carrier blade 160, and second a head and foot trimming mechanism 83 that trims the head and foot of the book while the book is held in a position other than horizontal, such as, a downwardly sloping or vertical position. On the third forward stroke of the single saddle 26', the book is moved from the clincher guides 155, 155', 158 and 158' at the stitcher position by the single saddle 26' onto a carrier blade 160 having a sloping input edge 161 and a large central opening 164. The carrier blade is movable in frame 163 connected to arm 162 and link arm 165. Link arm 165 pivots at 167 and is connected to rod 150. Any ordinary linkage connecting means (not shown) may be used between link arm 165 and rod 150. Carrier blade 160 moves upward each time sensor 78 is actuated. The carrier blade 160 may be actuated by a separate book switch, hydraulic controller and hydraulic cylinder similar to book switch 78, hydraulic controller 138, and hydraulic cylinder 140. The carrier blade 160 as shown in the drawings is moved upward to move a book out of the face trimming mechanism at the beginning of the third reverse movement of the single saddle 26', assuming a book is placed in the stitching position.

At the beginning of the third reverse movement of the single saddle, just prior to the upward movement of carrier blade 160, a horizontal knife blade 169 is moved perpendicular to the carrier blade 160 by a hydraulic cylinder 166 to trim the face of the book. The horizontal blade 169 moves through the opening 164 in the carrier blade 160. The knife blade 169 is adjustable upwardly or downwardly. The knife blade is adjustable to trim the faces of varying-sized books.

The hydraulic cylinder 166 may be actuated by a switch (not shown) similar to longitudinally adjustable switch 78 or a mechanical drive (not shown) at the initial stage of the third reverse movement of the single saddle to the right as shown in FIG. 16. The knife edge 169' includes a leading edge and a trailing edge, when viewed from the top to provide a scissor-type cutting action. The hydraulic cylinder 166 includes drive shaft 168 to drive the knife blade 169 and pressure bar 170. The pressure bar 170 is biased by a spring 172 into engagement with the book to hold the book securely against the upper portion of the fixed knife blade 174 for trimming purposes. The knife blade 169 is either driven or biased rearwardly to its original position. When the knife blade 169 and pressure bar 170 are returned to their original positions, carrier blade 160 is then moved upwardly to move the book into engagment with the book drive rolls 176 and 178.

Figure 18:
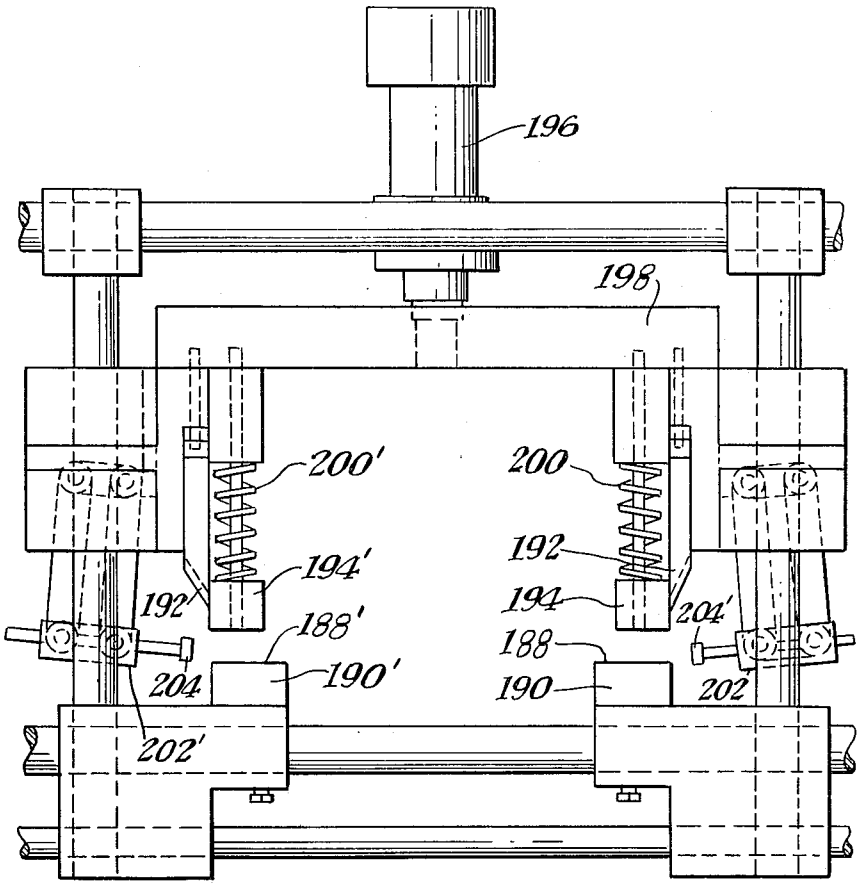
FIG. 18, is a side view of the head and foot trimmer.
Figure 17:
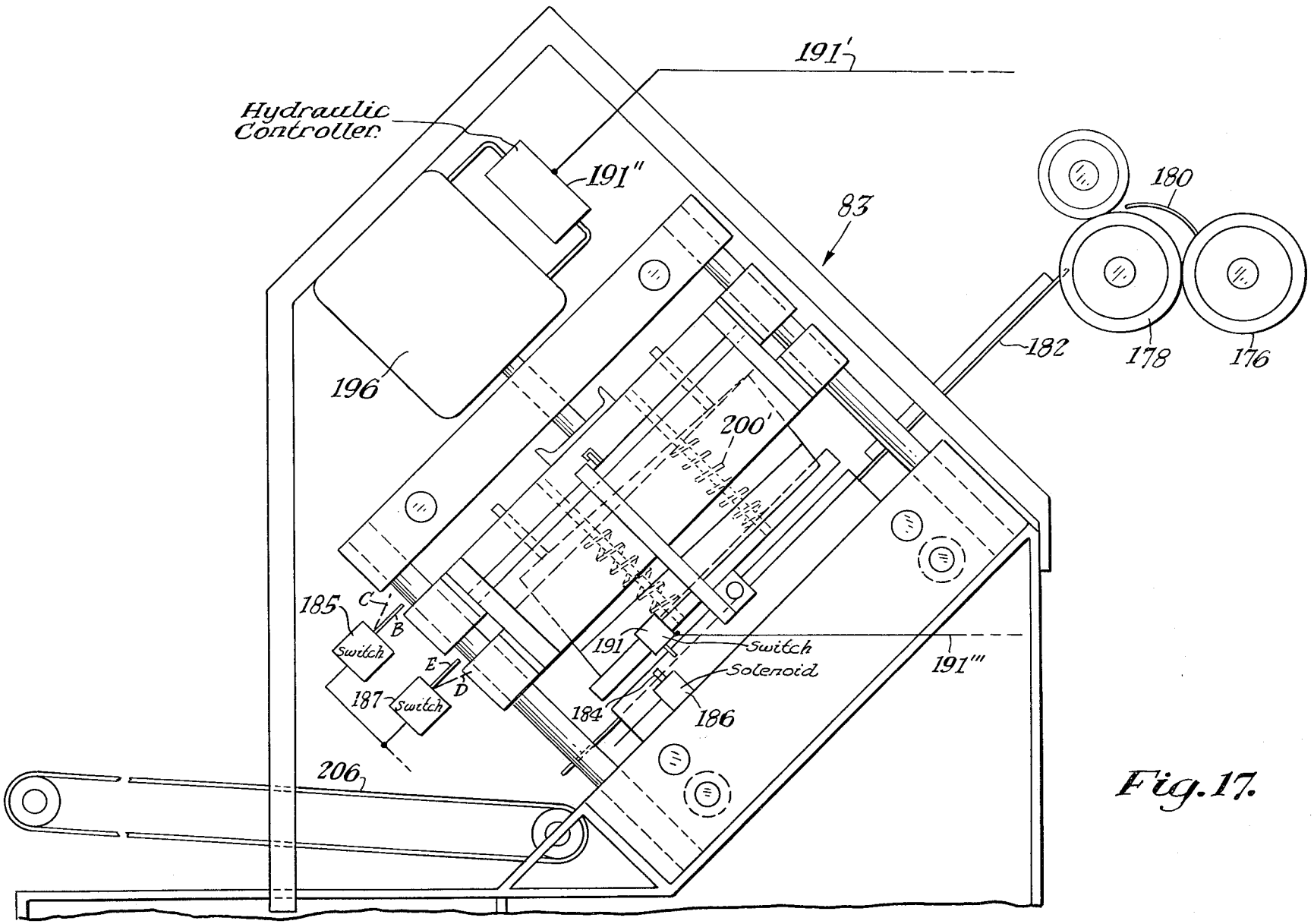
FIG. 17, is an end view of the head and foot trimmer.

The drive rolls 176 and 178, as shown in FIGS. 16 and 17, provide centrifugal force to move the book into engagement with the guide member 180. The guide member 180 and lower guide 182 aid in directing the book downwardly into a head and foot trim position. The head and foot trim position holds the book in a position other than a horizontal position. The head and foot trim position may be generally vertical, but it is preferably positioned at a sloping angle between a horizontal and vertical position. The book is moved into the head and foot trim mechanism 83 by rollers 176 and 178, and guides 180 and 182, with the aid of gravity, as shown in FIGS. 17 and 18. The back of the book engages the movable stop 184. Solenoid 186 moves stop 184 into and out of the path of movement of a book in the head and foot trim mechanism 83. Switches 185 and 187 actuate solenoid 186. The book comes to rest on surfaces 188 and 188'. The surfaces 188 and 188' are at the distal ends of the base knife blades 190 and 190'. The foot knife blade 192', clamp 194' along with the base knife blade 190', and registration means 202' are adjustable to the right or left, as shown in FIG. 18. Hydraulic cylinder 196 is actuated by a book sensing switch 191 to trim the head and foot of the book. The hydraulic cylinder 196 drives member 198 to move the clamps 194 and 194' through spring 200 and 200' into engagement with the book, the clamps leading the knives 192 and 192'. Registration means 202 and 202' are driven by member 198. Registration means 202 and 202' are actuated just prior to clamping the book between clamps 194 and 194' and surfaces 188 and 188' respectively. The arms 204 and 204' move the book into its proper trim position. The knife blades 192 and 192' are moved into engagement with the clamped book to trim the head and foot of the book. Thereafter stop 184 is lowered to allow the book to drop onto the delivery conveyor 206.

Figure 19:
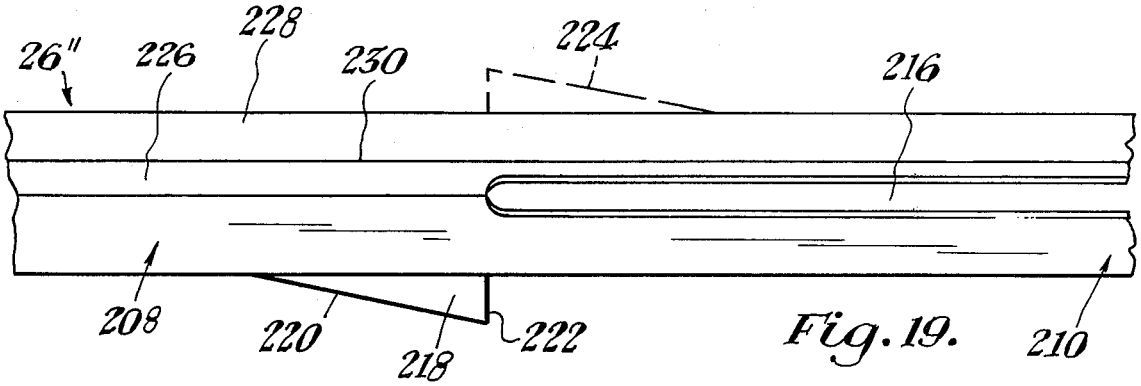
FIG. 19, is a partial top view of the split saddle.
Figure 20:
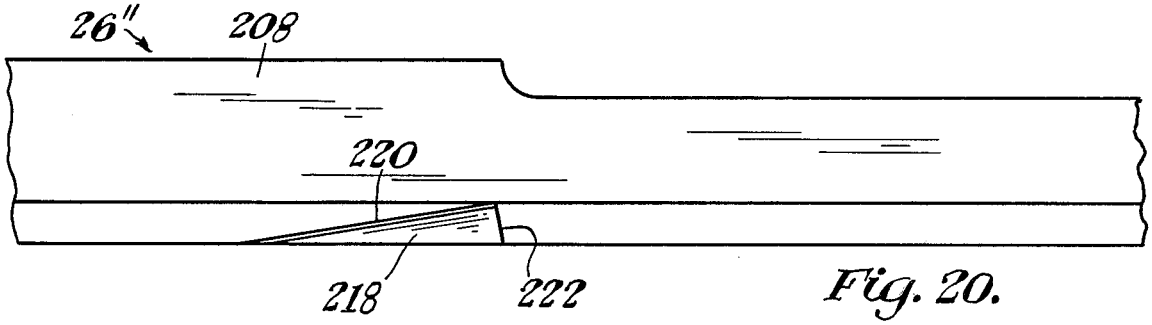
FIG. 20, is a partial side view of the split saddle.
Figure 21:
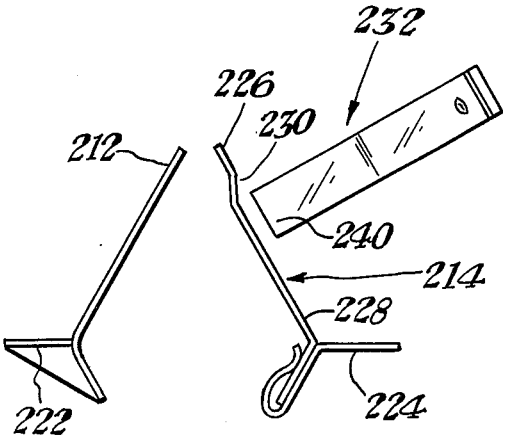
FIG. 21, is a cross-sectional view of the split saddle.
Figure 23:
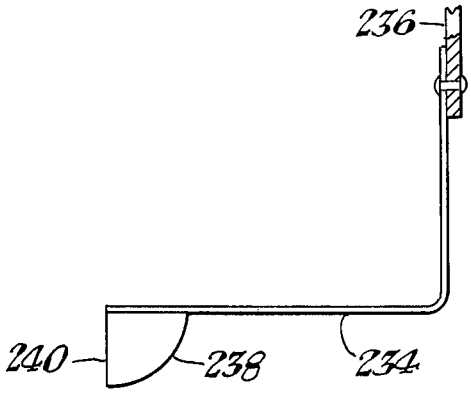
FIG. 23, is a side view of a biased stripper finger.

Referring now to FIGS. 19, 20, and 21, the single saddle 26' has a first portion 208 and a second portion 210 having two sides or arms. The inserting side or arm 212 and a collating side or arm 214 form an opening 216 extending along the entire length of the second side 210. A plurality of fixed finger 218 are connected to the single saddle 26'' to move the inserted work from station to station. Each finger has a by-pass cam surface 220 and a pushing surface 222. The book may be held in position by biased stripper fingers shown in FIGS. 21 and 23. A plurality of removable collating fingers 224 may be connected as shown in FIGS. 19 and 21. The collating side of the single saddle 26'' includes a top surface 226 and a lower surface 228 inwardly spaced from said top surface 226. Ridge 230 divides the two surfaces. The surface design allows the inserting work to be easily maintained in the forward position of the saddle by means of stripper fingers. The stripper finger 232 includes a flat spring 234 connected to the base face 236. Cam 238 allows the book to pass under the stripper finger. The flat face 240 holds the book in its' forward position.

Figure 22:
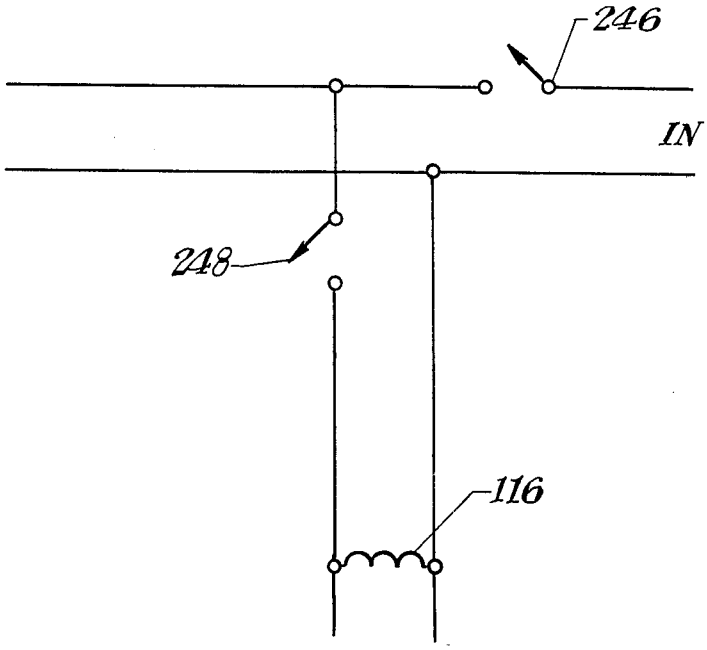
FIG. 22, is an electrical schematic of the machine.

Referring now to FIG. 22, the main power switch 246 is utilized to terminate all power to the caliper-switch and trim device when the signature-arranging device is used to collate. Switch 248 controls the operability of the ejection coil 116 of the ejection means 74. Switch 248 is opened to prevent movement of the ejection means 74.

Figure 24:
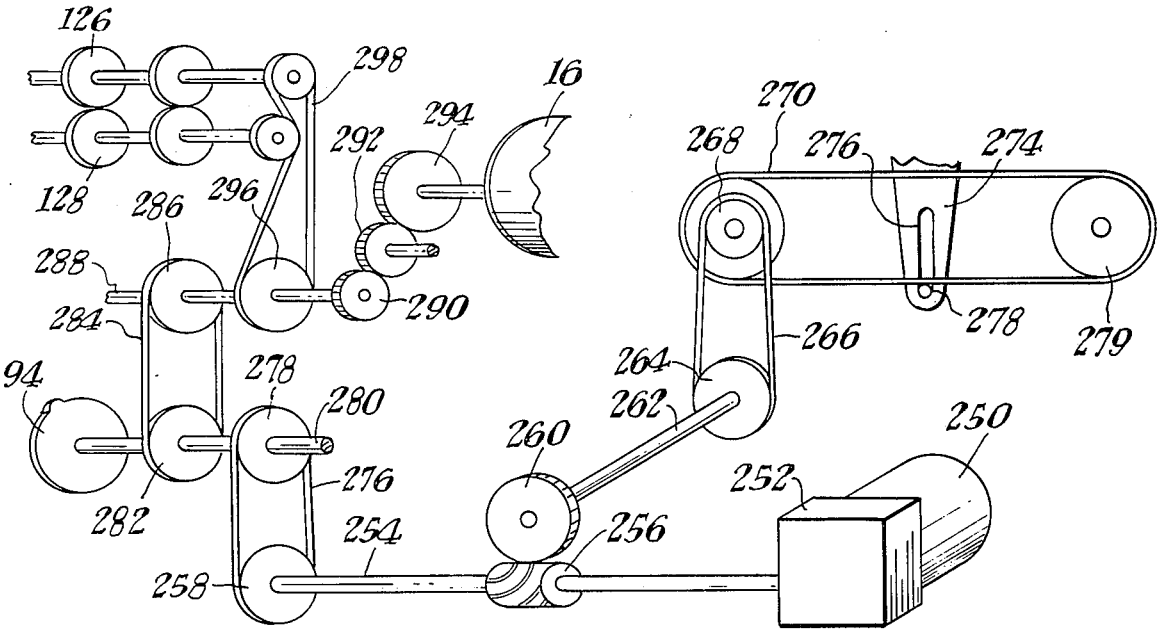
FIG. 24, is a mechanical schematic of the drive means.

Referring now to FIG. 24, the main drive motor 250 is connected to gear box 252 that drives the main shaft 254. The main shaft 254 includes the saddle drive gear 256 and chain sprocket 258. The saddle drive gear meshes with gear 260 to drive the saddle shaft 262, drive sprocket 264, chain 266, primary sprocket 268, saddle drive chain 270, and idler sprocket 279. The reciprocating saddle drive plate 274 with slot 176 is driven by pin 278 carried by the saddle drive chain 270. The saddle drive plate 274 is connected to the reciprocating saddle 26''.

The main shaft 254 drives sprocket 258, chain 276, sprocket 278, caliper shaft 280 to drive caliper actuating cam 94. The shaft 280 drives sprocket 282, chain 284, sprocket 286 to drive transfer shaft 288 and gear train 290, 292 and 294 to drive transfer cylinders 16. The shaft 288 drives sprocket 296 and chain 298 to drive the eject rollers 126 and 128.

Figure 25:
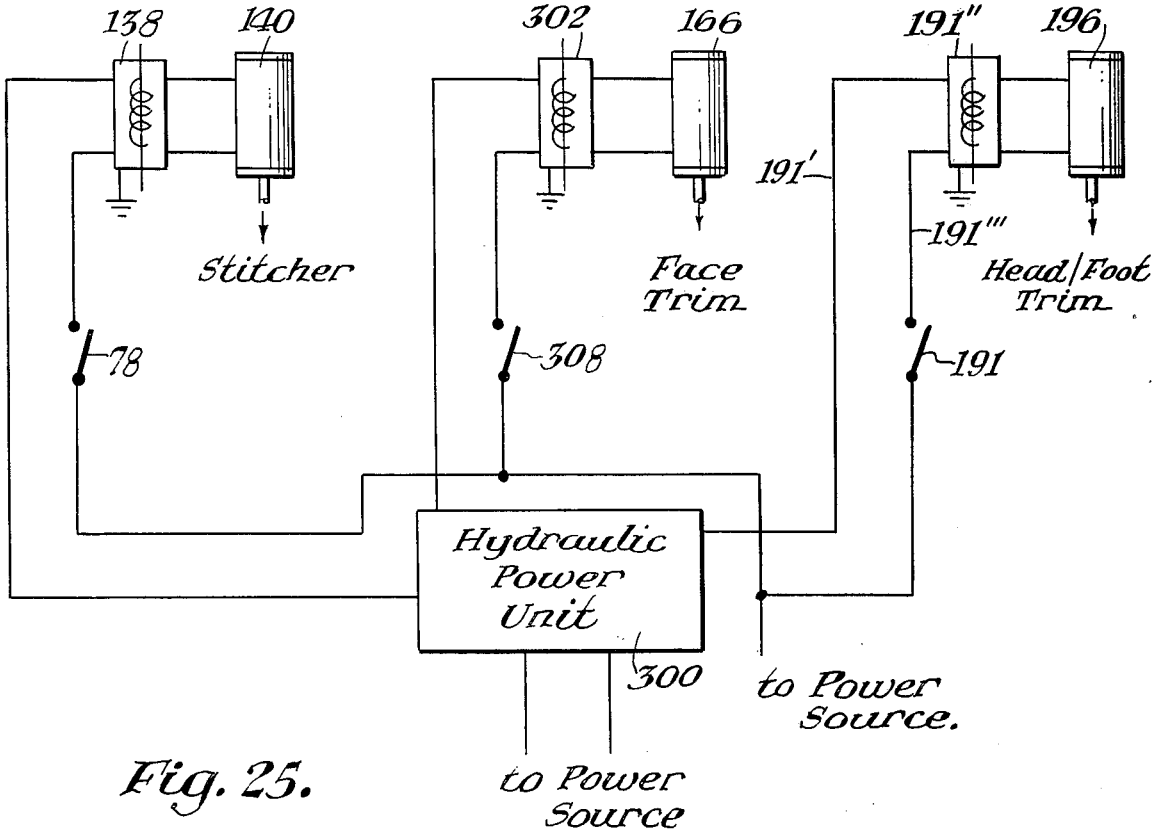
FIG. 25, is a hydraulic schematic of the actuating means.
Figure 26:
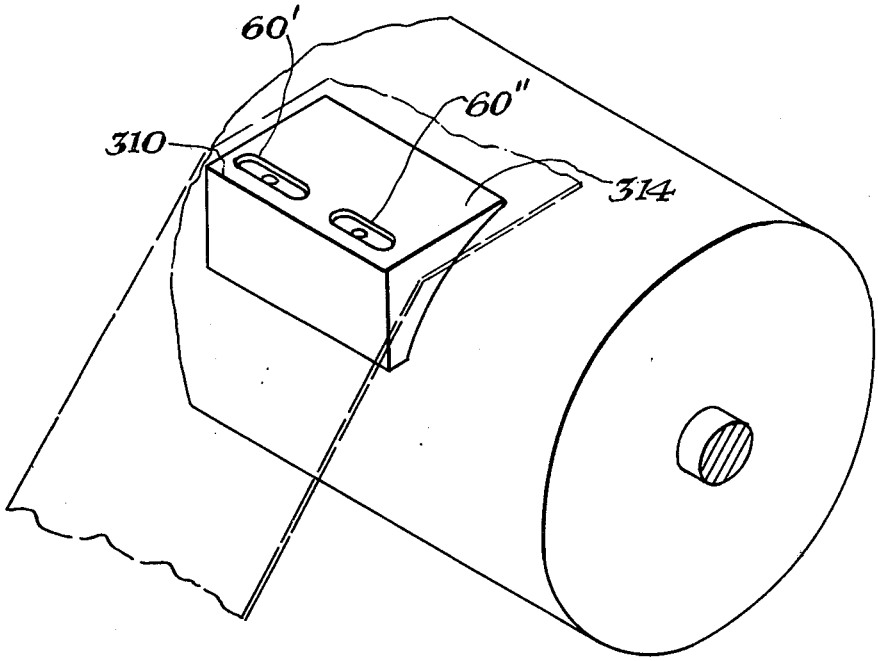
FIG. 26, is a perspective view of a pickeup means.

Referring now to FIG. 25, the hydraulic power unit 300 provides hydraulic fluid under pressure to hydraulic cylinders 140, 166 and 196 through hydraulic controllers 138, 302 and 191''. The hydraulic controllers 138, 302 and 191'' are actuated by switches 78, 308 and 191 respectively. For example, as shown in FIGS. 17 and 25, when switch 191 is actuated, hydraulic controller 191'' is activated through a signal on line 191'''. Also when switch 185 is moved from position B to C by a projection, not shown, on member 198, the movable stop 184 is moved by solenoid 186 into an extended position as shown in FIG. 17. When switch 187 is moved from position D to E a number of seconds prior to the operation of switch 185, the movable stop 184 is moved by solenoid 186 into a retracted position to allow a signature to move out of the trimmer onto conveyor 206.

Further reference is made to FIG. 1, showing the pickup box 46 with the single channel 60 in the upper plate. This structure may be modified by providing two channels with the same longitudinal center line instead of the single elongated channel 60. The two channels 60' and 60'' provide positive pickup of the next sheet of material to be moved from the magazine 13. The two channels 60' and 60'' are preferrably narrower in width than channel 60 with each of the two channels having a longitudinal length less than one half of the longitudinal dimension B. Surface 312' in FIG. 5 preferrably falls off from surface 314 at a 90° angle. The two channels are placed close to the edge or breaking line 310 with their longitudinal center lines generally parallel to the edge 310. After the material is attached to surface 314 and the movement of the drum causes the forward edge of the adjacent or attached sheet of material to move away from its original plane of rest. The edge 310 of the pickup box 46 is used to brake the material, that is, to crease the material over edge 310. The movement of the adjacent sheet of material aids in separating the adjacent sheet of material from the other sheets in the magazine and/or the other sheets in the signature.

The instant invention has been shown and described herein in what is considered to be the most practical and preferred embodiment. It is recognized, however, that departures may be made therefrom within the scope of the invention and that obvious modifications will occur to a person skilled in the art.

What I claim is:

1. A combination of a signature-arranging device and a caliper-stitch and trim machine comprising:

a signature-arranging device positioned at a first position, a caliper-stitch and trim machine positioned at a second position, said caliper-stitch and trim machine including a caliper means for providing work test standards for measuring the thickness of the signatures positioned at a caliper station, a stitching means positioned at a stitching station downstream of said caliper means, and a trimming means positioned at a trimming station, a common saddle means in said signature-arraning device to accumulate work from said signature-arranging device to form books and move the books through said caliper means, then through said stitching means, and into at least a portion of said trimming means, and drive means connected to said caliper-stitch and trim machine to reciprocate said common saddle means to carry signatures through said signature-arranging device to and through at least a portion of said caliper-stitch and trim machine.

2. A combination of a signature-arranging device and a caliper-stitch and trim machine as set forth in claim 1 wherein;

said caliper-stitch and trim machine includes means to provide a caliper test standards and is positioned and arranged to receive the books from the said signature-arranging device and said common saddle means moves the books first into said caliper means, second into said stitching means, and third into said trimming means, and an eject means connected to said caliper means and said drive means to eject books not meeting caliper test standards.

3. A combination of a signature-arranging device and a caliper-stitch and trim machine comprising:

a signature-arranging device positioned at a first position for arranging single pieces of work into a combined work product, a caliper-stitch and trim machine positioned at a second position inculding a caliper means for measuring the thickness of the work to provide test standards at a caliper station, a stitching means for connecting the single pices of work at a stitching station, and a trimming means for trimming the work at a trimming station, a common saddle means positioned in and between said signature-arranging device and in said caliper-stitch and trim machine for supporting and moving the work from and through said signature-arranging device and to and through at least a portion of said caliper-stitch and trim machine, a drive means connected to said signature-arranging device and said caliper-stitch and trim machine for driving said signature-arranging device and said caliper-stitch and trim machine, and a reciprocating drive means connected to said common saddle means to reciprocate said common saddle means to carry signatures through said signature-arranging device to and through at least a portion of said caliper-stitch and trim machine.

4. A combination of a signature-arranging device and a caliper-stitch and trim machine as set forth in claim 3 including;

an eject means for ejecting calipered work not meeting caliper means standards at the caliper station, said saddle means accumulates work from said signature-arranging device in the form of inserted signatures, and said saddle means includes two separated arms over which said inserted signatures move through said caliper station and said stitching means and into said trimming means, said separated arms provide an intermediate opening therebetween for said eject means to move to eject signatures and said stitching means to move to stitch signatures.

5. A combination of a signature-arranging device and a caliper-stitch and trim machine as set forth in claim 3 wherein;

said signature-arranging device provides inserted signature books on said saddle means, and said saddle means is shaped to support and move the backbone of said books along a generally straight line path.

6. A combination of a signature-arranging device and a caliper-stitch and trim machine as set forth in claim 5 including;

an eject means at the caliper station, and said saddle means includes two separated arms which support said inserted signature books as they are moved first through said caliper station, then through said stitching position, and thereafter into said trimming means.

7. A combination of a signature-arranging device and a caliper-stitch and trim machine as set forth in claim 3 wherein;

said saddle means includes two separated arms over which inserted signatures from said signature-arranging device are positioned said stitiching means including moving stitching means operable between said arms.

* * * * *